US008313006B2

(12) United States Patent
Willner et al.

(10) Patent No.: US 8,313,006 B2
(45) Date of Patent: Nov. 20, 2012

(54) FOIL CONTAINER

(75) Inventors: Ralf Willner, Tussenhausen (DE); Josef Glogger, Buchloe (DE); Armin Baessler, Koenigsbrunn (DE); Frank Thiemann, Landsberg/Lech (DE); Thomas Buergel, Landsberg/Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 626 days.

(21) Appl. No.: 12/460,770

(22) Filed: Jul. 24, 2009

(65) Prior Publication Data

US 2010/0027918 A1 Feb. 4, 2010

(30) Foreign Application Priority Data

Jul. 25, 2008 (DE) ..... 10 2008 040 738

(51) Int. Cl.
*B65D 35/22* (2006.01)

(52) U.S. Cl. ..... 222/94; 222/137; 222/326; 222/541.4

(58) Field of Classification Search ..... 222/94, 222/132, 541.4, 137, 325–327
See application file for complete search history.

(56) References Cited

U.S. PATENT DOCUMENTS

| | | | | |
|---|---|---|---|---|
| 3,861,522 | A * | 1/1975 | Llewellyn et al. | 206/219 |
| 4,227,612 | A * | 10/1980 | Dillon | 206/219 |
| 4,913,553 | A * | 4/1990 | Falco | 366/129 |
| 5,480,067 | A * | 1/1996 | Sedlmeier | 222/107 |
| 5,697,524 | A * | 12/1997 | Sedlmeier | 222/82 |
| 6,012,610 | A * | 1/2000 | Pauser et al. | 222/88 |
| 6,085,941 | A * | 7/2000 | Pauser et al. | 222/92 |
| 6,129,244 | A | 10/2000 | Hoerth | |
| 6,352,177 | B1 * | 3/2002 | Bublewitz et al. | 222/82 |
| 7,325,703 | B2 * | 2/2008 | Gherdan et al. | 222/94 |
| 7,510,546 | B2 * | 3/2009 | Baessler et al. | 604/408 |
| 2006/0175348 | A1 * | 8/2006 | Wood | 222/94 |

* cited by examiner

*Primary Examiner* — Kevin P Shaver
*Assistant Examiner* — Daniel R Shearer
(74) *Attorney, Agent, or Firm* — Abelman, Frayne & Schwab

(57) ABSTRACT

A foil container for storing components of a multi-component mass and for being inserted in a receptacle of an ejection device, includes a first foil bag (12) that stores at least one component (16) of the multi-component mass, a second foil bag (22) arranged next to the first foil bag (12) and that stores at least two components (26, 27) of the multi-component mass separately from each other, and a head portion (31) having at least two receiving sections (32, 36) for receiving respective ends (13, 23) of the first and second foil bags (12, 22).

14 Claims, 2 Drawing Sheets

FOIL CONTAINER

BACKGROUND OF THE INVENTION

1. Field of the Invention

The present invention relates to a foil container for storing components of a multi-component mass and for being inserted in a receptacle of an ejection device and including a first bag for storing at least one component of the multi-component mass, a second foil bag arranged next to the first foil bag and for storing separate from each other, at least two components of a multi-component mass, and a head portion having at least two receiving sections for receiving respective ends of the first and second foil bags.

2. Description of the Prior Art

Multi-component masses such as, e.g., mortar-, foam-, and sealing masses are made available to a user in cartridges and foil containers. Foil containers have proved themselves for storing such masses and advantageously distinguish from cartridges by a smaller portion of material that need be disposed after the mass contained therein is brought out. In addition, foil containers can be easily and cost-effectively produced.

A foil container is placed or inserted in a receptacle of an ejection device, e.g., of a dispenser. An ejection mechanism simultaneously ejects the components through an outlet opening provided in the head portion of the foil container. Usually, after the ejection, the ejected mass passes through a mixing housing having a mixing member. In the mixing housing, separate components are mixed with each other to form the desired mass.

European Patent EP 0 914 069 B1 discloses a foil container of the type described above and including two, arranged next to each other, foil bags for receiving each a component of a two-component mass. This arrangement of foil bags is called a side-by-side arrangement.

A drawback of foil containers, such as disclosed, e.g., in EP 0 914 069 B1, consists in that they can be used only for storing two-component masses and can be inserted only in one receptacle of an ejection device. When the use of three-component masses or masses with more than three components is required, up to now, special ejection devices and containers, which have a complicated construction and which are, therefore, cost-intensive in manufacturing, were required.

Accordingly, an object of the present invention is to provide a foil container for storing masses consisting of more than two components and which can be used with an ejection device for a two-component mass.

SUMMARY OF THE INVENTION

This and other objects of the present invention, which will become apparent hereinafter, are achieved by providing a foil container of the type described above in which the first foil bag contains at least one component of a multi-component mass, and the second foil bag contains at least two components of the multi-component mass.

The dimensions of a foil container according to the present invention correspond essentially to dimensions of a foil container for a two-component mass. Therefore, the foil container according to the present invention can be used with conventional ejection devices already available on the market. In accordance with the type of a mass to-be-stored in the inventive foil container and the requirements the stored mass must meet, its components can be stored in the foil container with a corresponding ratio to each other. In the inventive foil container, more than three components can be stored, which can be ejected after the foil container was placed in a receptacle of an ejection device.

Advantageously, the second foil bag has at least two foil bag chambers for separately storing the at least two components of the multi-component mass. Thereby, a reaction of the two components with each other is prevented. In order to form a separate foil bag chambers in the second foil bag, advantageously, a separation wall is provided in the second foil bag. The separation wall prevents a direct contact of the at least two components with each other during storage of the components in the second foil bag. Thus, there is no contact region between the two components in which a reaction can take place.

If a multi-component mass consists of only two component, then, the first foil bag stores a first portion of the first component of the multi-component mass, and the at least two foil bag chambers of the second foil bag store, respectively, a second portion of the first component and the second component of the multi-component mass different from the first component. The larger of the two components of the two-component mass can be divided in two equal or unequal portions. This makes possible to obtain different mixing ratios of two components with a constant dimension of the foil container. E.g., it is possible to realize in a conventional foil container dimensioned for a mixture ratio 3:1 and a differing therefrom, mixture ratio 5:1.

Further, this embodiment of the foil container permits to produce an injection mortar without specific marking which has a high strength but which, however, need not be particularly marked. Whether a foil container should be marked depends on the content of materials requiring marking, e.g., on the content of peroxide and/or sensitizing metanacrylates. Peroxides (e.g., perester, perketal, hydro- or diacyl-peroxide, in particular, butylperbenzoate, cumylhydroperoxide, dibenzoylperoxide, or lauroylperoxide) often are used as hardeners, e.g., for a mortar for chemical anchoring of fastening elements. If a peroxide content at a conventional side-by-side arrangement of the foil bags is reduced to a marking-free limit of 1%, the strength of a hardenable multi-component mass is noticeably reduced. The strength of a hardenable multi-component mass cannot be increase, at such arrangement, by changing the mixture ratio, e.g., from 3:1 to 5:1, because the available total concentration of peroxides would be reduced further.

By dividing the first component in two portions stored in separate foil bags, the peroxide content can be concentrated in one of the chambers of the second foil bag of the foil container with peroxide content amounting to above 1%. Thereby, the peroxide content with regard to the components in the second foil bag which has two foil bag chambers can be reduced to below 1% at mixture ratios from 1:1 to 10:1. Thus, this embodiment of the invention permits to realize a strong injection mortar that can be free of any marking and, thus, be handled without any particular procedure.

Advantageously, the ratio of the second portion of the first component to the second component is in a range from 0.5:1 to 7:1, preferably from 2:1 to 5:1, and a ratio of the entire first component to the second component is in a range from 1:1 to 10:1, preferably in a range from 2:1 to 7:1. The foregoing ratios of components or portions of the components to each other insure availability of hardenable mass with different strength and which do not require a particular marking.

Advantageously, the first and second foil bags are fixedly secured at their respective ends to the head portion and, thus, are connected with the head portion without a possibility of being lost. Thereby, the entire foil container can be simply placed in a receptacle of an ejection device and be removed therefrom. Advantageously, the foil bags are glued to the head portion.

Advantageously, at least one of the first and second foil bags has, at its end adjacent to the receiving section of the head portion, a weakness that opens under pressure. Thereby, upon application of pressure, e.g., with a pressing piston of the ejection device, the foil of the foil bag is teared off in the region of the weakness. This foil bag can be open very easily. The weakness of the foil bag is preferably formed with a laser which removes a portion of the layers of a usually multi-layer foil of the foil bag. If the multi-layer foil has an isolation layer, then, advantageously the outer layer or layers are removed at least in one region up to the isolation layer.

Advantageously, the weakness extends in a region spaced from a locking element of the foil bag. The foil bag is usually gathered together at its ends and is closed, e.g., with a clip. The weakness advantageously is provided in region between the locking element and an outer circumference of the corresponding foil bag. The weakness advantageously extends over a certain section of the foil bag over a radially extending or linear flat region. The weakness can be formed as a continuous or discontinuous weakness.

Advantageously, the head portion has two through-channels for connecting the respective receiving sections with an outlet opening provided in the head portion, and the at least one of the first and second foil bags is so arranged in a respective receiving section that a middle point of a flat section of the weakness is pivoted with respect to a corresponding through-channel.

Advantageously, the middle point of the flat region of the weakness is pivoted with respect to the corresponding through-channel by an angle from −135° to 135°. As a result, after opening, during the ejection process, the ejected component(s) move essentially straight in the through-channel and through the outlet opening in the head portion. It is particularly advantageous when the middle point is pivoted relative to the corresponding through-channel in an angular region from −45° to 45°.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

In the drawings, the same elements are designated with the same reference numerals.

DETAILED DESCRIPTION OF THE PREFERRED EMBODIMENTS

Figure 1:
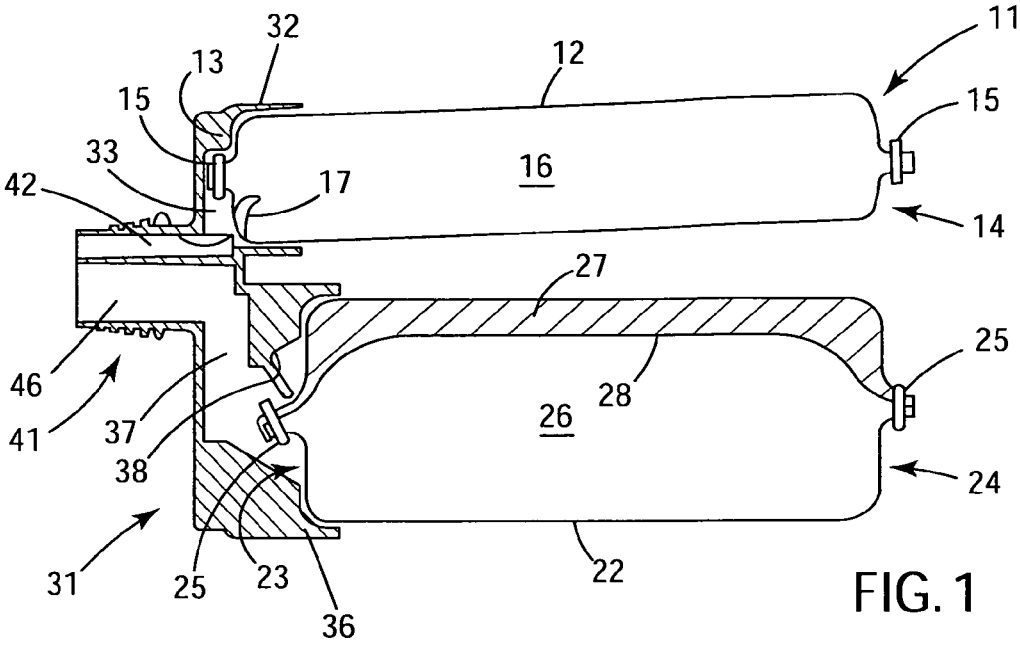
FIG. 1 a side view of a foil container according to the present invention with the head portion shown in cross-section.
Figure 2:
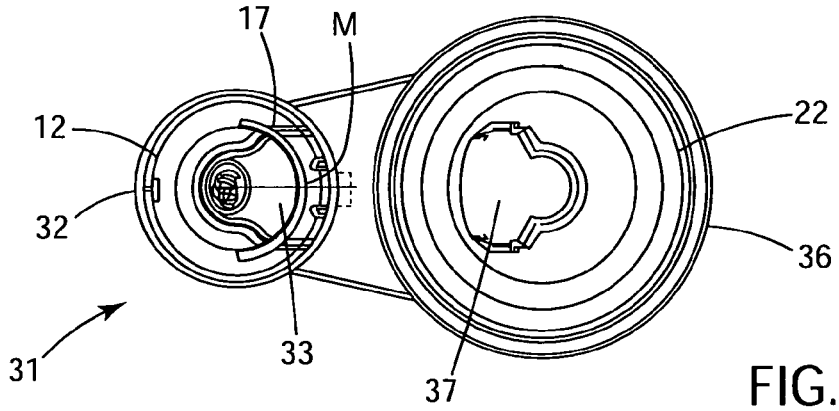
FIG. 2 a left-side view of the foil container shown in FIG. 1 illustrating the arrangement of the foil bags in the head portion according to a first embodiment of the present invention.

A foil container 11 according to the present invention which is shown in FIG. 1 and is designed for storing components of a multi-component mass and for being inserted in a receptacle of an ejection device, not shown, has a first foil bag 12 for a first component 16 of a three-component mass and a second foil bag 22 located near the first foil bag 12 and designed for storing a second component 26 and a third component 27 of the three-component mass separately from each other and from the first component 16. The second and third components 26, 27 are stored in separate foil bag chambers of the second foil bag 22 and which are formed by a common separation wall 28 provided in the second foil bag 22.

The first foil bag 12 is gathered at its both ends 13 and 14, with each end being closed with a clip that forms a locking element 15. The second foil bag 22 is likewise gathered at its both ends 23 and 24, with each end being closed with a clip that forms a locking element 25.

The foil container 11 further has a head portion 31 with a first receiving section 32 for the end 13 of the first foil bag 12 and a second receiving section 36 for the end 23 of the second foil bag 22, with the foil bags 12, 22 being fixedly secured with their corresponding ends 13, 23 to the head portion 31, without a possibility of being lost. In the head portion 31, there is provided a first through-channel 33 that connects a receiving chamber, which is formed by the first receiving section 32, with a first outlet channel 42 of an outlet opening 41. In the head portion 34, there is also provide a second through-channel 37 that connects a receiving chamber, which is formed by the second receiving section 36, with a second outlet channel 46 of the outlet opening 41. On a section of the head portion 31 in which the opening 41 is provided, there is formed an outer thread for connection with a mixing housing, not shown, in which a nixing element is located. In the mixing housing, the components 16, 26, 27, which are ejected from foil bags 12 and 22, are intermixed during the ejection process to form a ready-for-use mass.

The first foil bag 12 is provided at its end 13 adjacent to the receiving section 32 at least in one region with a weakness 17 that opens under pressure. The weakness 17 extends over a surface region spaced from the locking element 15 of the foil bag 12. The first foil bag 12 is so arranged in the first receiving section 32 that the middle point M of the surface region of the weakness 17 is located directly above the first through-channel 33.

The ejection device applies pressure to the ends 14 and 24 of the foil bags 12 and 22 remote from the head portion 31. When the inner pressure in the first foil bag 12 reaches a certain level, the foil of the first foil bag 12 is teared off in the region of the weakness 17. Therefore, during an ejection process the component 16, which is located in the foil bag 12, exits through the first through-channel 33, the first outlet channel 42, and out from the outlet opening 41. When the inner pressure in the second foil bag 22 reaches a certain level, the locking element 25 at the first end 23 of the second foil bag 22 is stripped off so that during the ejection process, the components 26, 27, which are located in the second foil bag 22 exit through the second through-channel 37 and the second outlet channel 46 and out from the outlet opening 41. In order to facilitate the stripping-off of the locking element 25 and to provide for a correct ratio of both components 26, 27 in the discharge during the ejection process, a flow throttle 38 is provided at the inlet of the second through-channel 37.

Figure 3:
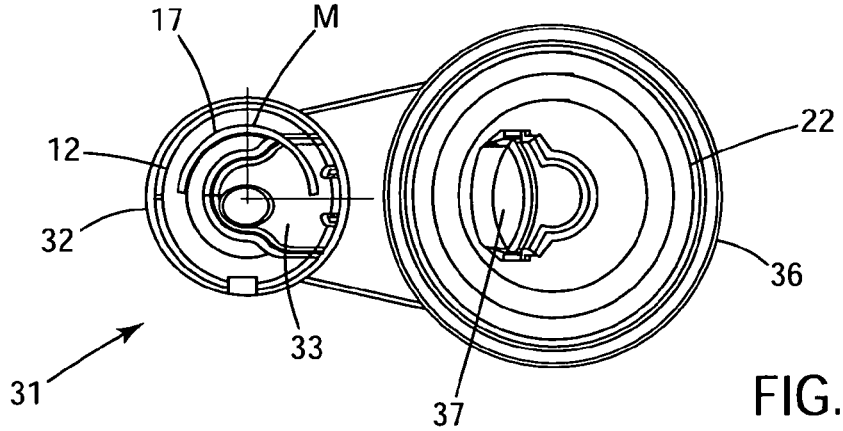
FIG. 3 a left-side view of the foil container shown in FIG. 1 illustrating the arrangement of the foil bags in the head portion according to a second embodiment of the present invention.

FIG. 3 shows a different arrangement of the foil bags 12, 22 in the head portion 31. In this arrangement, the middle point M of the surface region of the weakness 17 of the first foil bag 12 is pivoted by an angle α of 90° with respect to the first through-channel 33 in the first receiving section 32.

Figure 4:
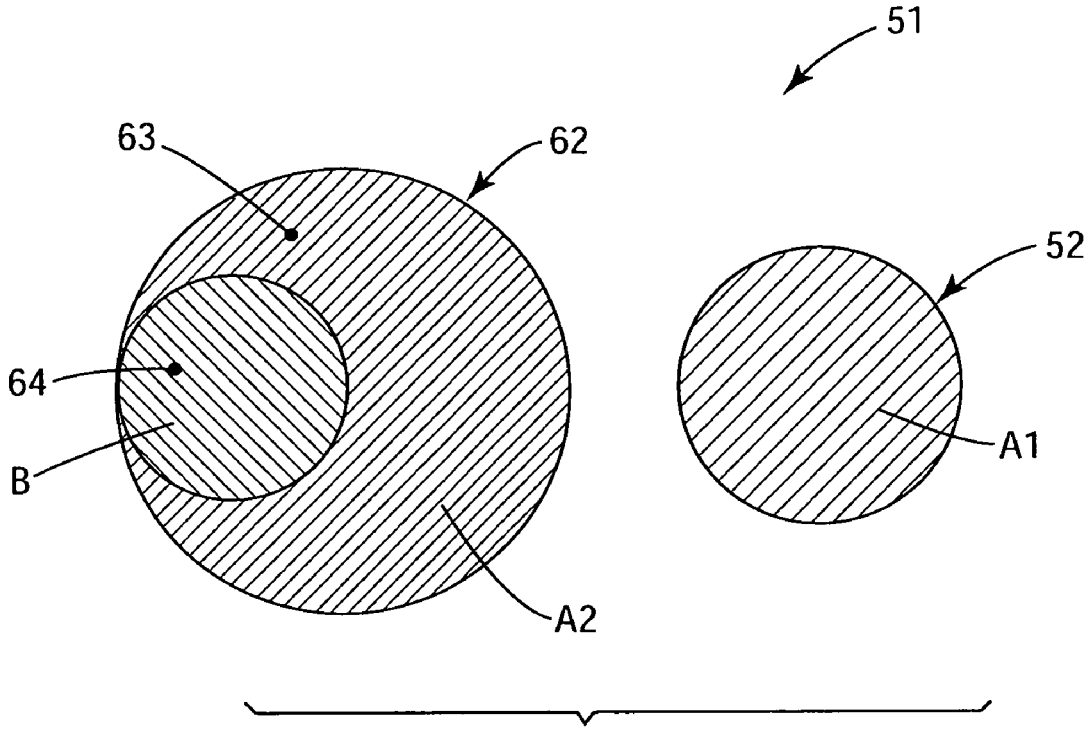
FIG. 4 a left-side view of the foil container shown in FIG. 1 illustrating the arrangement of the foil bags in the head portion according to a third embodiment of the present invention, with the foil bags shown in cross-section.

A foil container 51 which is shown in FIG. 4 and is designed for storing mass components and for being inserted in a receptacle of an ejection tool, not shown, has a first foil bag 52 and a second foil bag 62 located near the first foil bag 52 for storing components of a two-component mass separately from each other.

A first portion A1 of a first non-marked component is located in the first foil bag 52 and a second portion A2 of the first component is located in a first foil chamber 63 of the second foil bag 62. The second foil bag 62 has a second foil chamber 64 in which a second component B different from the first component A of the multi-component mass, is located. The ratio of the second portion A2 of the first component to the second component B is a range from 0.5:1 to 7:1, preferably, in a range from 2:1 to 5:1. The ratio of the entire first component to the second component B is in a range from 1:1 to 10:1, preferably in a range from 2:1 to 7:1.

The second component B contains peroxide in an amount above 1%. However, the total content of peroxide in a hardenable mass stored in the foil bag 62 is below 1%. Therefor, the foil bag 62 and the foil container 51 have no marking.

Though the present invention was shown and described with references to the preferred embodiments, such are merely illustrative of the present invention and is not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A foil container for storing components of a multi-component mass and for being inserted in a receptacle of an ejection device, the foil container comprising a first foil bag (12) for storing at least one component (16) of the multi-component mass; a second foil bag (22) arranged next to the first foil bag (12) and for storing at least two components (26, 27) of the multi-component mass separately from each other; and a head portion (31) having at least two receiving sections (32, 36) for receiving respective ends (13, 23) of the first and second foil bags (12, 22), wherein the second foil bag (22) has at least two foil bag chambers for separately storing the at least two components (26, 27) of the multi-component mass, and wherein the first foil bag (52) stores a first portion (A1) of the first component of the multi-component mass, and the at least two foil bag chambers (63, 64) of the second foil bag (62) store, respectively, a second portion (A2) of the first component and the second component (B) of the multi-component mass different from the first component.

2. A foil container according to claim 1, wherein a ratio of the second portion (A2) of the first component to the second component (B) is a range from 0.5:1 to 7:1, and a ratio of the entire first component to the second component is in a range from 1:1 to 10:1.

3. A foil container according to claim 2, wherein the ratio of the second portion (A2) of the first component to the second component (B) is a range from 0.2:1 to 5:1, and the ratio of the entire first component to the second component is in a range from 2:1 to 7:1.

4. A foil container according to claim 1, wherein the first and second foil bags (12, 22) are fixedly secured at the respective ends (13, 23) thereof to the head portion (31).

5. A foil container according to claim 1, wherein at least one (12) of the first and second foil bags (12, 22) has, at the end (13) thereof adjacent to the receiving section (32) of the head portion (31), a weakness (17) opening under pressure.

6. A foil container according to claim 5, wherein the weakness (17) extend in at least one region spaced from locking means (15) of the at least one of the first and second foil bags (12, 22).

7. A foil container according to claim 5, wherein the head portion (31) has two through-channels (33, 37) for connecting the respective receiving sections (32, 36) with an outlet opening (41) provided in the head portion (31), and wherein the at least one (12) of the first and second foil bags (12, 22) is so arranged in a respective receiving section (32) that a middle point (M) of a flat region of the weakness (17) is pivoted with respect to a corresponding through-channel (33).

8. A foil container according to claim 7, wherein the middle point (M) of the flat region of the weakness (17) is pivoted with respect to the corresponding through-channel (33) by an angle (α) from −135° to 135°.

9. A foil container according to claim 8, wherein the middle point (M) of the flat region of the weakness (17) is pivoted with respect to the corresponding through-channel (33) by an angle (α) from −45° to 45°.

10. A foil container for storing components of a multi-component mass and for being inserted in a receptacle of an ejection device, the foil container comprising a first foil bag (12) for storing at least one component (16) of the multi-component mass; a second foil bag (22) arranged next to the first foil bag (12) and for storing at least two components (26, 27) of the multi-component mass separately from each other; and a head portion (31) having at least two receiving sections (32, 36) for receiving respective ends (13, 23) of the first and second foil bags (12, 22), wherein at least one (12) of the first and second foil bags (12, 22) is formed as a multi-layer foil bag and has, at the end (13) thereof adjacent to the receiving section (32) of the head portion (31), a weakness (17) opening under pressure, the weakness (17) being formed by a region of the at least one of the first and second foil bags at least an outer layer of which is removed with a laser.

11. A foil container according to claim 10, wherein the weakness (17) extend in at least one region spaced from locking means (15) of the at least one of the first and second foil bags (12, 22).

12. A foil container according to claim 10, wherein the head portion (31) has two through-channels (33, 37) for connecting the respective receiving sections (32, 36) with an outlet opening (41) provided in the head portion (31), and wherein the at least one (12) of the first and second foil bags (12, 22) is so arranged in a respective receiving section (32) that a middle point (M) of a flat region of the weakness (17) is pivoted with respect to a corresponding through-channel (33).

13. A foil container according to claim 12, wherein the middle point (M) of the flat region of the weakness (17) is pivoted with respect to the corresponding through-channel (33) by an angle (α) from −135° to 135°.

14. A foil container according to claim 13, wherein the middle point (M) of the flat region of the weakness (17) is pivoted with respect to the corresponding through-channel (33) by an angle (α) from −45° to 45°.

* * * * *